United States Patent [19]

Cranberg

[11] 4,069,808

[45] Jan. 24, 1978

[54] APPARATUS AND METHOD FOR COMBUSTION

[76] Inventor: Lawrence Cranberg, 1205 Constant Springs Drive, Austin, Tex. 78746

[21] Appl. No.: 605,290

[22] Filed: Aug. 18, 1975

[51] Int. Cl.[2] ..... F23H 13/00

[52] U.S. Cl. ..... 126/164; D7/207

[58] Field of Search ..... 126/30, 153, 154, 137, 126/163, 164, 165, 135, 136, 336; D7/207

[56] References Cited

U.S. PATENT DOCUMENTS

| | | | |
|---|---|---|---|
| 2,585,523 | 2/1952 | Wellman | 126/164 X |
| 2,868,189 | 1/1959 | Watrous | 126/30 X |
| 2,985,165 | 5/1961 | Peterson et al. | 126/165 |
| 2,998,001 | 8/1961 | Lofgren et al. | 126/30 X |
| 3,612,034 | 10/1971 | Wood et al. | 126/165 |

*Primary Examiner*—Ronald C. Capossela
*Attorney, Agent, or Firm*—Kenneth R. Glaser

[57] ABSTRACT

A method and apparatus for the controlled combustion of combustible materials is disclosed whereby the combustion is confined within a slot defined by a plurality of combustible logs in longitudinal contact and opening toward the objects to be heated.

11 Claims, 10 Drawing Figures

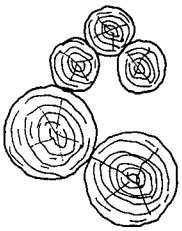
fig.5A
fig.5B
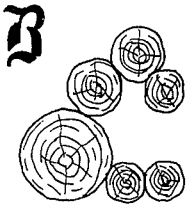
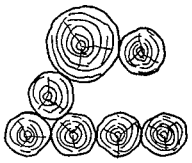
fig.5C
fig.5D
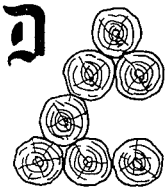
fig.6
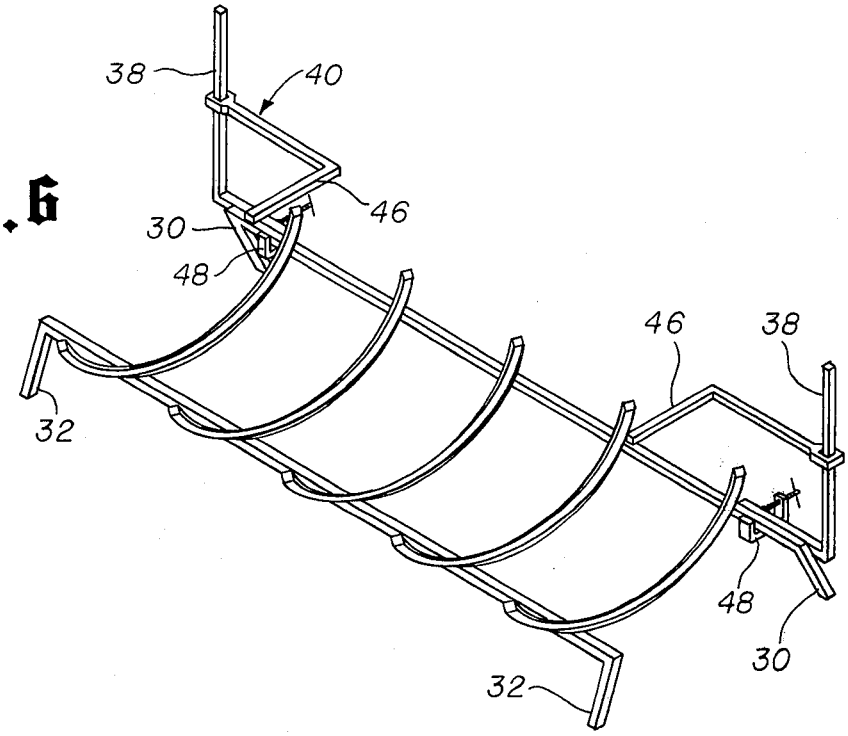
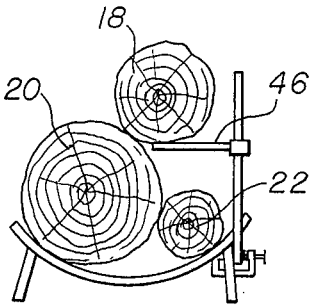
fig.7

APPARATUS AND METHOD FOR COMBUSTION

BACKGROUND OF THE INVENTION

This invention relates to methods and apparatus for achieving controlled combustion of combustible materials, and more particularly, to an apparatus and methods of directing thermal radiation produced by such controlled combustion.

One problem which arises from the use of known apparatus and methods for burning combustible materials, such as domestic fireplace grates for combustion of wooden logs, is that a substantial fraction of the radiant heat from the combustion of such logs is directed toward the walls of the fireplace in which the grate is positioned. Therefore, the use of this type of apparatus and its method for combustion is highly inefficient. Examples in the prior art which show grates which burn logs in this manner are U.S. Pat. Nos. 3,670,714 to Eyges (1972), 3,505,986 to Wood (1970), 2,985,165 to Peterson, et al (1961), 2,585,523 to Wellman (1952), 1,418,411 to Ward (1922), 780,800 to Keferstein (1905), and 2,057,659 to Daniel (1936). The need for achieving optimum use of chemical energy stored in natural fuels by combustion is recognized as a contemporary problem. See, for example, *Heat Transfer in Fires: Thermophysics, Social Aspects, Economic Impact,* edited by Perry L. Blackshear, Halsted Press Division, John Wesley and Sons, 1975. No. apparatus or method is presently known which controls combustion of combustible materials so that thermal radiation is controlled primarily by the combustible materials themselves and directed with substantial efficiency in a desired direction.

Another problem which arises in the burning of combustible materials such as wooden logs is that apparatus and methods are needed for initiating combustion of said combustible materials easily.

Applicant is aware of the following U.S. Patents which generally describe the state of art in apparatus and methods for fireplace combustion but which do not provide satisfactory solutions to the above problems: U.S. Pat. Nos. 3,277,882 to Rose (1966); 2,408,935 to Kunst (1946); 267,499 to Dankers (1882); 746,539 to Low (1903); 2,600,753 to Gilbert (1952).

Applicant solves the problems of producing controlled and efficient combustion of combustible materials, which combustion is easily initiated, by providing an apparatus and method for using the same which is described more fully herein.

It is therefore an object of this invention to provide am apparatus and method for arrangng combustible materials in a geometric configuration defining a slot for controlled and efficient combustion.

It is a further object of this invention to provide a method and apparatus for providing a configuration of combustible materials whereby the thermal energy can be directed.

It is still a further object of this invention to provide a method and apparatus for burning combustible materials in a fireplace whereby a minimum of thermal radiation is directed towards the fireplace and chimney walls.

It is still a further object of this invention to provide a method and apparatus for the burning of combustible materials whereby ignition of said combustible materials is accomplished easily.

It is a further object of this invention to provide a method and apparatus for the burning of combustible materials which reduces the risk of chimney fires when used in a domestic fireplace.

It is still a further object of this invention to provide a method and apparatus for burning combustible materials which reduces the amount of fuel required for delivering a given amount of thermal radiation in a specific direction, or toward specific objects.

It is still a further object of this invention to provide a method of burning logs which prolongs the life of fireplace grates.

It is a still further object to provide a method and apparatus to eliminate the need for expensive fireplaces which are designed to direct thermal radiation from the fire to the room.

It is a further object of this invention to provide an improved apparatus for changing from a slot fire to a conventional fire quickly.

It is another object of this invention to provide an improved method and apparatus for arranging combustible materials in a defined geometric configuration which requires little attention to produce a steady output of heat.

Other objects will be apparent from the drawings, the specification and the claims.

BRIEF DESCRIPTION OF THE DRAWINGS

In the drawings wherein like reference numerals indicate like parts and wherein the illustrative embodiments of this invention are shown.

FIGS. 5A, 5B, 5C, and 5D are alternative embodiment methods of achieving a slot fire with logs.

FIG. 6 is an alternative embodiment apparatus embodying applicant's invention.

FIG. 7 illustrates the logs of FIG. 2 supported by the apparatus of FIG. 6.

DESCRIPTION OF THE PREFERRED EMBODIMENTS

The scientific principle of which applicant's invention is a derivative states that any heat source, in order to radiate thermal energy efficiently, should approximate an enclosure having a small aperture opening in the direction in which thermal radiation energy is desired. Heat radiation emitted within the enclosure which is not directed through the aperture is absorbed by the walls of the enclosure and is thereafter reemitted. Assuming that the inner surfaces of the enclosure are thermally insulated from their external environment, substantially all the thermal radiation from the enclosure is emitted through the opening in a generally radial direction from the center of the enclosure.

Figure 1:
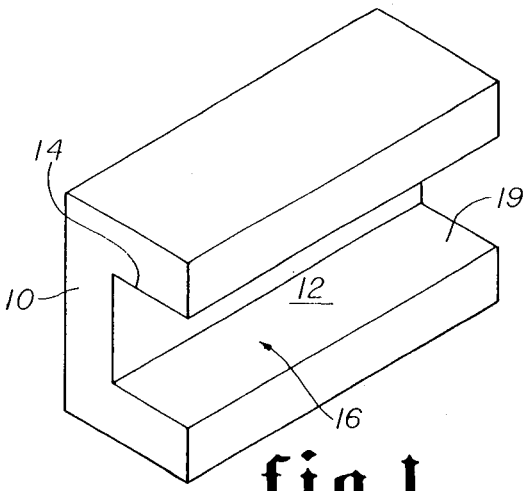
FIG. 1 is a perspective view of the geometric configuration of combustible materials which result in improved combustion.

A method for achieving many of the theoretical advantages of thermal radiation, as described above, is illustrated in conjunction with FIG. 1. As shown in FIG. 1, a combustible material 10, preferably of low thermal conductivity such as commonly available woods, is provided having surfaces which define a combustion region 12 whose length is substantially greater than its depth and height. As used in the specification and claims herein, the term "slot fire" shall be used to describe a fire which burns in a slotted space such as space 12 which is defined by combustible material 10. A slot fire tends to fill the length of the slot.

Figure 2:
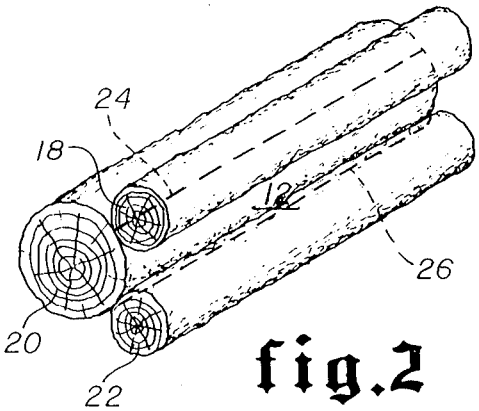
FIG. 2 is a perspectie view of three combustible logs which approximate the geometric configuration of FIG. 1.

Although the geometric configuration of combustible material as shown in FIG. 1 may support a slot fire, it has been found that the properties of the slot fire are enhanced and the advantages of applicant's invention are better realized by providing the combustible materials 10 with means for supplying ventilation to the slot fire in addition to the front opening of the material. This desired arrangement can be provided by defining the slot for a slot fire by common combustible logs such as logs 18, 20, and 22 as shown in FIG. 2. The term "log" as it is used in the specification and claims herein shall mean any solid material which is combustible whose form is generally cylindrical.

Logs 18, 20 and 22 of FIG. 2 generally approximate the geometric configuration of combustible material of FIG. 1, but include an improved combustion environment allowing ventilation of the slot 12 from the space 24 between logs 18 and 20 and the space 26 between logs 20 and 22 in addition to the long and lateral opening of slot 12. Logs 18 and 20 are positioned with their axes parallel and their sides in generally longitudinal contact along line 24. Likewise logs 20 and 22, whose axes are substantially parallel, are also generally in contact along their lengths along line 26, but with openings due to the irregularities of natural materials.

Applicant has discovered that the arrangement of combustible materials as shown in FIG. 2, which provides a means for defining a slot for combustion whereby the slot opens toward a region where thermal radiation is desired, achieves high efficiency of combustion since a substantial amount of the thermal radiation generated is directed outwardly from slot 12. If applicant's method of combustion is practiced in a domestic fireplace, the slot 12 will open toward the room or object to be heated. This method clearly provides an improved method of generating heat from burning logs in a fireplace since a substantial amount of the thermal radiation is directed out into the room in which the fireplace is located rather than against the fireplace walls as with prior art methods. Applicant has also discovered the the arrangement of combustible materials as shown in FIG. 2 provides an improved combustion environment in that only a small amount of priming is required in region 12 to initiate a slot fire, which then burns the length of the slot. Applicant has discovered that kindling is not required for starting the slot fire and that it can be started with paper alone.

Figure 3:
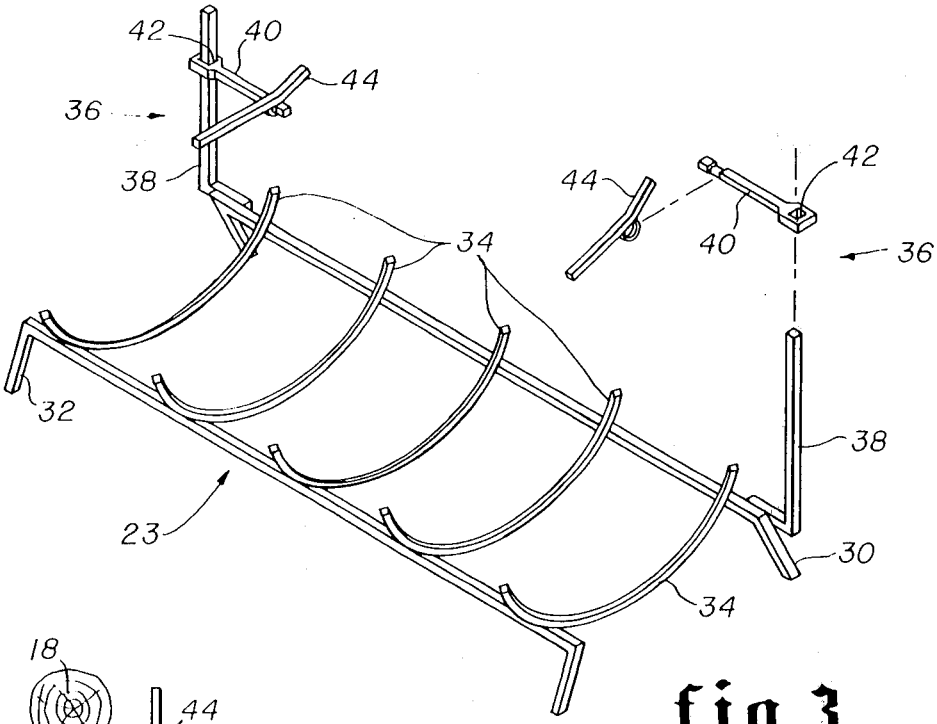
FIG. 3 is a perspective view of a fireplace apparatus embodying the invention.

Applicant achieves the method of combustion as shown in FIG. 2 in his preferred embodiment by the apparatus shown in FIG. 3. The apparatus shown in FIG. 3 comprises a means for supporting a plurality of logs in a geometric configuration which defines a slot to sustain a slot fire.

A means for supporting the front log 22 and back log 20 includes a base 23 which, in the preferred embodiment, comprises a pair of base foundation members 30 and 32 having legs which allow the foundation members to be elevated for proper ventilation. Foundation members 30 and 32 support a plurality of rib members 34. Since rib members 34 are curved transverse to the axes of the logs, ribs 34 continually force logs 20 and 22 which are supported by said ribs in a direction toward each other so that substantial space created between said logs due to combustion is prevented and the slot for the slot fire will be maintained. Thus, base 23 including ribs 34 provide a means for retaining logs 22 and 20 in longitudinal contact both initially and during combustion.

A means for supporting one or more logs in contact with the logs supported by base 23 in order to define a slot for supporting a slot fire comprises support members 36. In the preferred embodiment, a pair of support members 36 each comprise a pair of L-shaped guide members 38 which are suitably fastened to the front of base 23 by welding or other suitable means at either side thereof providing two substantially vertical guide arms. Attached to each guide arm 38 is a support arm 40 which is adjustably mounted on the guide member 38 and extends horizontally and inwardly toward the other support arm 38. The means for adjustably mounting said support arm 40 on guide member 38 includes a socket 42 within support arm 40 which loosely accomodates guide member 38 as shown in FIG. 3. The relative cross-sectional widths of socket 42 and guide member 38 are designed so that the weight of support member 40 by itself causes member 40 to be locked vertically to guide member 38. As weight is added to support arm 40, this locking force is increased.

Figure 4:
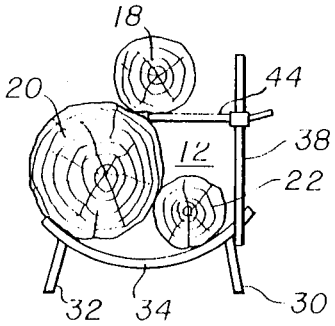
FIG. 4 is a side view of the apparatus of FIG. 3 supporting the logs of FIG. 2.

Support means 36 includes a support finger 44 which is rotatably mounted on support arm 40. As shown in FIG. 4, fingers 44 are positioned between the top log 18 and back log 20. As a fire in slot 12 consumes portions of logs 18, 20, and 22, the vertical position of all three logs will decrease. The purpose of finger 44 in addition to supporting top log 18 is to rotate as logs 20 and 18 drop in vertical height, thereby maintaining longitudinal contact along the lengths of logs 20 and 18 as the slot fire consumes the logs.

It will be appreciated that support arms 40 may be lowered to the extreme lower position on guide members 38 so that support arms 40 are in contact with base 28 so that the apparatus can be used as a conventional fire place grate.

Clearly, the slot fire produced by Applicant's invention can be used to heat a room. However, Applicant has discovered that his invention may be used to advantage also to heat objects such as food or cooking utensils containing food. Applicant believes that placing food or cooking utensils spaced apart horizontally from the slot fire will achieve the desired cooking environment while avoiding the usual disadvantages of having the food permeated with smoke and allowing grease drippings to fall on the fire. Thus, Applicant's invention can be used for many applications in which thermal radiation is desired.

In operation, the apparatus of FIG. 3 is used to support a plurality of logs. Assuming that three logs are used as illustrated in FIG. 4, a log 22 of a given diameter is positioned on the front of the base and a second log 20 of substantially larger diameter is positioned in longitudinal contact with front log 22 as shown. Then, the support arms 36 are adjusted to the proper height to support a third log 18 in longitudinal contact with back log 20. Logs 18, 20 and 22 thus fine an elongated slotted space 12 which opens generally toward the region to be heated. A primer such as paper is then placed in the slot 12 and ignited. Applicant has discovered that a small fire ignited anywhere along the slot will quickly spread throughout the entire slot. During combustion, the fire in slot 12 will consume the portions of logs 18, 20 and 22 which define the slot 12. Some combustion also occurs in the longitudinal spaces between logs 18 and 20 and between logs 20 and 22, thus consuming these portions of the logs. Base 23, because of its upward concave curvature, and the force of gravity, continually forces logs 20 and 22 together in longitudinal contact thus preventing substantial separation of logs 20 and 22 and also maintaining slot 12 in its original configuration. Likewise support finger 44 pivotally moves as logs 20 and 18 are consumed by fire, thus maintaining logs 18 and 20 in continuous longitudinal contact and maintaining slot 12 substantially in its original slot configuration.

Applicant has discovered that the front log 22 is consumed by the slot fire most rapidly. Thus, after log 22 has been substantially exhausted, a new log may easily be placed in the position of log 22, thus maintaining the definition of slot 12 for the slot fire. Likewise logs 18 and 20 may be replaced as needed.

ALTERNATIVE EMBODIMENTS

It will be appreciated that other embodiments of apparatus and methods of combustion in addition to the foregoing preferred embodiments are possible without departing from the spirit and scope of applicant's invention.

For example, the arrangement of these logs as shown in FIG. 2 clearly defines a slot which supports a slot fire having the advantages described herein but this arrangement is not unique. Other arrangements of logs which support a slot fire for practicing applicant's method are illustrated in FIGS. 5A, 5B, 5C, 5D.

Also, clearly other apparatus besides the apparatus of FIGS. 3 and 4 will maintain logs in a geometric configuration to support a slot fire without departing from the scope of Applicant's invention.

For example, as shown in FIGS. 6 and 7, an alternative apparatus for maintaining logs in the configuration of FIG. 2 is illustrated. The alternative apparatus is substantially identical to the apparatus of FIG. 3 with two exceptions. First, the rotating support finger 44 of FIG. 3 has been replaced in the apparatus of FIGS 6 and 7 with a non-rotatable support finger 46. As shown in FIG. 7, the top log 18 is supported in part by finger 46 and log 20. Finger 46 serves the same function as finger 44 in that it both supports the top log 18 and provides a means for maintaining log 18 and log 20 in longitudinal contact as the slot fire causes the logs to be consumed.

The other structural difference between the apparatus of FIGS. 6 and 7 and that of FIG. 3 is the presence of an adjustable tension bracket 48 which releasably connects support means 36 to base 23. This alternative embodiment is very practical since the base 23 is the prior art grate which many consumers presently own. By attaching either variety of support means 36 shown in FIG. 3 or in FIGS. 6 and 7 by bracket 48, a known grate can be modified easily to practice applicant's invention.

Therefore, methods and apparatus have been described which produce controlled and efficient combustion of logs whereby thermal energy from combustion may be directed to a defined region and whereby ignition properties of the logs is enhanced for easier starting than has been known heretofore.

While the invention has been particularly shown and described with reference to a preferred and alternate embodiment thereof, it will be understood by those skilled in the art that the foregoing and other changes in form and detail may be made therein without departing from the spirit and scope of the invention.

I claim:

1. A method for achieving controlled and efficient combustion from combustible materials, comprising the steps of:

selecting pieces of combustible materials whose lengths are substantially greater than their cross-sectional dimension;

arranging said pieces of combustible materials in general contact along their longest dimensons, said pieces of material being substantially parallel to one another;

positioning said pieces of material in a geometric configuration defining a slot formed by said pieces, said slot extending substantially parallel to said pieces of combustible material, and said slot opening predominantly toward the region in which thermal radiation is desired; and igniting a fire in said slot formed by said combustible materials.

2. The method of claim 1 including maintaining the combustible materials in longitudinal contact during combustion so that definition of the slotted region in which combustion occurs is maintained.

3. Apparatus for the efficient heating of an object by thermal radiation, comprising in combination:

a. first, second, and third sets of logs, said sets each comprising at least one log and longitudinally oriented with respect to one another in a generally C-shaped geometric configuration with the first, second, and third sets of logs respectively providing the upper, lower, and rear legs of said C-shaped geometric configuration, the first and second sets of logs each having at least one log thereof in generally continuous longitudinal contact with a log of said third set, thereby to define an elongated combustion slot having an axis substantially parallel to the axes of said first, second, and third log sets, said combustion slot being substantially enclosed on three sides and open in the direction toward said object, and b. support means for maintaining said first, second, and third logs in said generally C-shaped geometric configuration as said logs are consumed by combustion.

4. The apparatus as defined by claim 3 wherein said support means comprises a first base portion continuously urging adjacent logs of said second and third sets toward one another and a second support leg maintaining the logs of said first set vertically spaced from the logs of said second set while simultaneously urging the logs of said first set toward the logs of said third set.

5. The apparatus as defined by claim 4 wherein said first base portion comprises a plurality of members which are curved concavely upwards.

6. The apparatus as defined by claim 3 wherein said second support leg is vertically spaced from said first base portion and is inclined downwardly in a direction toward said first base portion.

7. Grate apparatus for supporting combustible logs, said grate apparatus comprising:

a. base support means comprising a plurality of laterally spaced rib members defining a generally horizontal extending platform for supporting selected ones of said combustible logs at one level, b. laterally spaced upright members joined with said base support means and vertically extending upwardly from said platform and c. elevated support means for supporting other ones of said combustible logs at a level above said one level, said elevated support means comprising laterally spaced fingers having respective end portions cantilevered over said base support means, coupling means respectively joining said fingers with said upright members in a manner which enables the increased inclination of said end portions toward said base support means when said elevated support means supports said other ones of said combustible logs, thereby to enable any logs on said elevated support means to come into contact with logs on said base support means.

8. The apparatus as defined by claim 3 wherein said fingers are vertically adjustable with respect to said base support means.

9. The apparatus as defined by claim 7 wherein said coupling means comprises support arms respectively horizontally extending from said upright members, said fingers rotatably mounted with said support arms for inclination toward said base support means.

10. Grate apparatus for maintaning combustible materials in longitudinal contact with one another during combustion, said grate apparatus comprising:

a. a base support including means defining a generally horizontally extending platform for supporting selected ones of said combustible materials at one level, and b. elevated support means for supporting other ones of said combustible materials at a second level above said first level, but in longitudinal contact with the combustible materials at said first level, said elevated support means comprising laterally spaced fingers so coupled with said base support that respective end portions of said fingers extend out over the horizontally extending platform and are inclined toward the horizontally extending platform, thereby to maintain longitudinal contact between combustible materials supported by said horizontally extending platform.

11. The apparatus as defined by claim 10 wherein said horizontally extending platform comprises a plurality of laterally spaced rib members having respective end portions inclined toward one another, thereby to urge combustible materials longitudinally disposed with respect to one another on said horizontally extending platform toward one another.

* * * * *